United States Patent [19]

Camfield et al.

[11] Patent Number: 4,762,317

[45] Date of Patent: Aug. 9, 1988

[54] STATIONARY EXERCISE DEVICE

[75] Inventors: David K. Camfield; Daniel F. Brashear, both of Olney; Marion N. Craig, Calhoun, all of Ill.

[73] Assignee: Roadmaster Corporation, Olney, Ill.

[21] Appl. No.: 45,535

[22] Filed: May 4, 1987

[51] Int. Cl.[4] ..... A63B 21/00; A63B 69/06

[52] U.S. Cl. ..... 272/73; 272/72

[58] Field of Search ..... 272/72, 73, 126, 146; 128/25 R

[56] References Cited

U.S. PATENT DOCUMENTS

| | | | |
|---|---|---|---|
| 3,759,512 | 9/1973 | Yount et al. | 272/73 |
| 4,140,312 | 2/1979 | Buchmann | 272/73 |
| 4,621,623 | 11/1986 | Wang | 272/72 |
| 4,664,372 | 5/1987 | Halvig | 272/73 |

FOREIGN PATENT DOCUMENTS

| | | | |
|---|---|---|---|
| 828005 | 8/1938 | France | 272/73 |
| 547710 | 5/1956 | France | 272/73 |
| 2390179 | 1/1979 | France | 272/73 |

*Primary Examiner*—Richard J. Apley
*Assistant Examiner*—S. R. Crow
*Attorney, Agent, or Firm*—Polster, Polster and Lucchesi

[57] ABSTRACT

A stationary exercise device has an elongated base frame, a seat supported by the base frame adjacent one end and a non-circular upright support adjacent the other end of the frame, and an exercise cycle assembly removably mounted on the support. The device preferably doubles as a rowing machine, the handle bars of the rowing machine serving a dual purpose.

2 Claims, 2 Drawing Sheets

STATIONARY EXERCISE DEVICE

BACKGROUND OF THE INVENTION

This invention relates to stationary exercise devices. Rowing machines, in which a stable frame is provided on which a seat is slideably mounted, and a pair of rowing arms, with handle bars and grips, pivoted to the frame, are restrained by dashpots, are well known. Some are provided with a post or socket at the foot end of the frame, to receive a post of a platform by which the rowing machine can be turned up on end to permit the exercise of muscles not used in the rowing regimen. Such a device is sold by Roadmaster Corporation, as its HEALTH MASTER 2400. Recumbent bicycles are also known, as exemplified by U.S. Pat. No. 4,618,160, issued Oct. 21, 1986. However, applicants are aware of no stationary recumbent exercise cycle, and particularly one in which the exercise cycle is demountable, and in which the handle bars of a rowing machine can be utilized in conjunction with the cycle, as well as for their conventional uses.

One of the objects of this invention is to provide a versatile stationary exercise machine.

Another object is to provide such a machine that is simple, rugged, convenient to use, and disassemblable for storage.

Other objects of this invention will be apparent to those skilled in the art in light of the following description and accompanying drawings.

SUMMARY OF THE INVENTION

In accordance with this invention, generally stated, in a stationary exercise device with an elongated base frame, a seat supported by the base frame adjacent one end of it and support means adjacent the other end of the frame, an exercise cycle assembly is mounted on the support means in such a way that it can be selectively demounted. The exercise cycle assembly includes pedals positioned to be reached by the feet of a human operator sitting on the seat.

The frame preferrably also carries rowing machine arms with handle bars and conventional dashpot restrainers, so that the device can also be used as a conventional rowing machine.

In its exercise cycle application, means are provided for attaching a back to the carriage on which the seat is mounted, and means are provided for clamping the seat in any desired position relative to the pedals of the exercise cycle to accommodate persons with different leg lengths.

The exercise cycle assembly is provided with a housing that supports an odometer or speedometer or both, and an adjusting knob for a mechanism for varying the resistance of the exercise cycle fly wheel, the adjustment knob being readily accessible to the person sitting on the seat. The housing is provided with a hand hold made integral with the housing and positioned at the top of the housing, so that the exercise cycle mechanism can easily be lifted from the support.

DESCRIPTION OF THE PREFERRED EMBODIMENT

Figure 1:
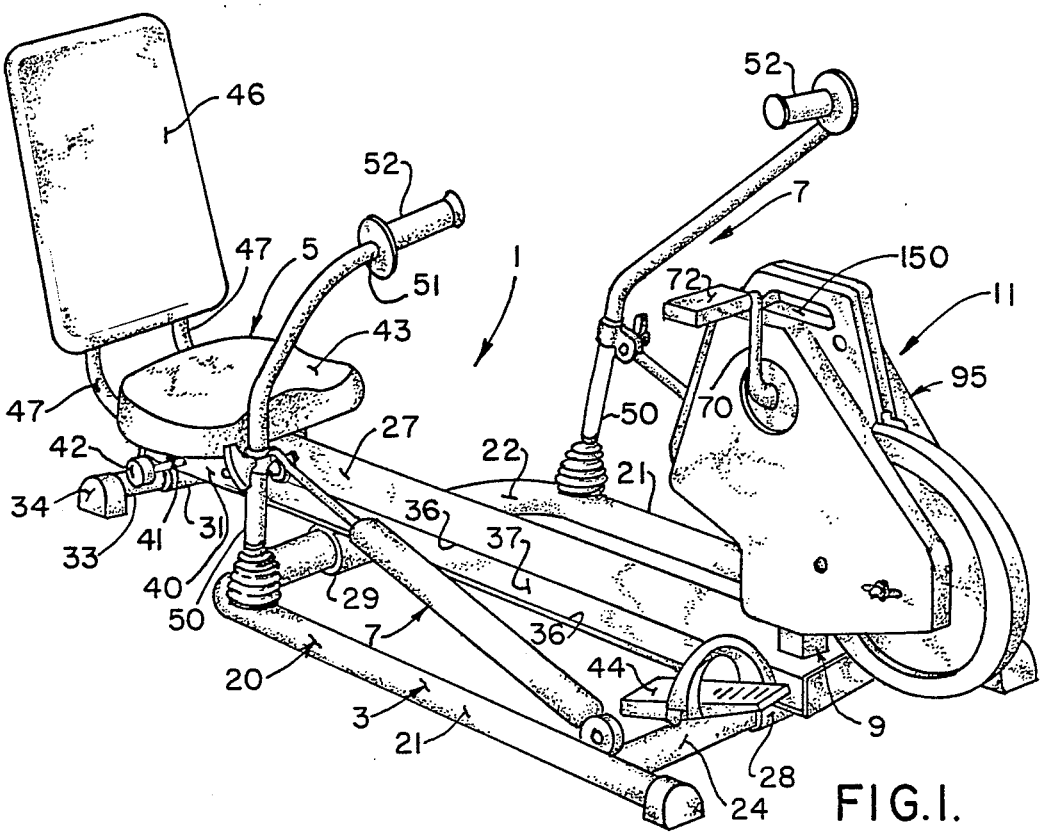
FIG. 1 is a view in perspective of one embodiment of stationary exercise device of this invention.

In the drawing, reference numeral 1 indicates a stationary exercise device of this invention, which includes a base 3, a seat assembly 5, a rowing machine assembly 7, a support structure 9, and an exercise cycle assembly 11.

The base is made up of a U shaped tubular frame 20, with legs 21 and a connecting reach 22 at the closed end of the U. At their free ends, the legs 21 have ground-engaging feet 23, a short distance inwardly from which the legs are connected by a crossbar 24. A central beam 27 has a crossbar sleeve 28 connecting it to the crossbar 24, and a connecting reach sleeve 29. The central beam 27 extends substantially beyond the connecting reach 22 in a direction away from the support structure 29, and is secured by a seat support sleeve 31 to a seat suport bar 33, equipped with feet 34. The central beam 27 has a planar top surface 35, and is provided with spaced upper and lower flanges 36 defining between them side channels 37, in which wheels, not here shown, of a seat carriage 40 ride. All of the structure thus far described is conventional.

In this embodiment, a seat carriage clamp bolt 41 is threaded into and through a threaded hole in one side wall of the seat carriage 40. The seat carriage clamp bolt has a knob 42 on its end to permit its being turned by hand. When the seat carriage clamp bolt is screwed inwardly, it engages a side wall 38 of the central beam, to clamp the seat carriage to the beam.

The seat carriage 40 carries a seat 43. At the support structure end of the base, mounted on the crossbar 24, are foot plates 44 for use in the rowing machine mode.

A seat back 46, with seat back frame arms 47 is mountable on and demountable from the seat carriage 40. The frame arms 47 have in them key-receiving holes. Two frame arm receivers, not here shown, open at their outer ends and of a size and shape slidably to receive the frame arms 47 are secured to the sides of the carriage 40, and are provided with holes with which the holes 48 can be selectively aligned to receive a key pin 49 of the type with a ring at one end and a spring biased detent at the other so as positively to retain the back rest arms in either of at least two selected positions when the pins 49 are in place and to permit the removal of the back rest when the pins are pulled.

Rowing arms 50 are pivotally mounted at their lower ends, conventionally, on the legs 21. At their upper ends, the arms 50 have handle bars 51 on which hand grips 52 are mounted. Dashpots 53 are mounted in the usual way, with a cylinder hingedly mounted at one end to the frame near or at the crossbar 24, and a piston rod hingedly and adjustably mounted on the arm 50.

In this embodiment, support means take the form of a square, hollow post 55 welded to and projecting perpendicularly from the top surface of the central beam 27 above the crossbar 24.

Figure 3:
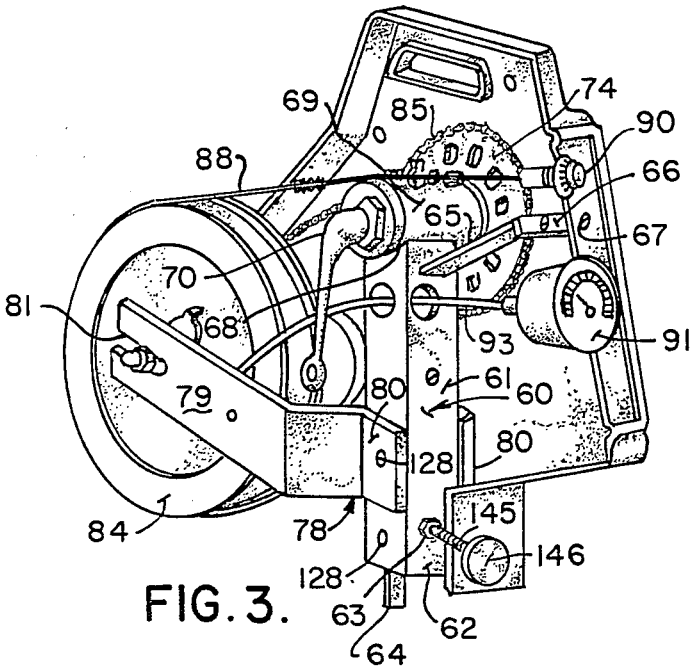
FIG. 3 is a somewhat enlarged view of the exercise cycle mechanism of the device shown in FIGS. 1 and 2, with one half of a housing removed.
Figure 5:
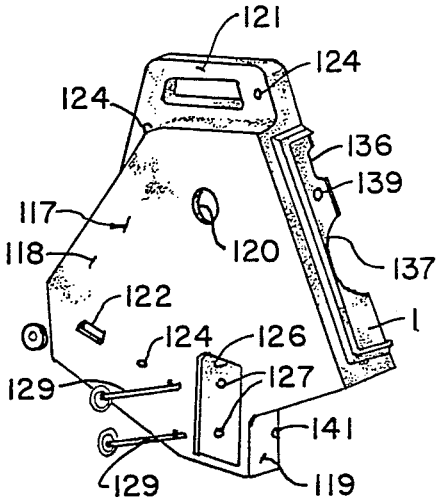
FIG. 5 is a view in perspective of one of two parts of the housing.
Figure 6:
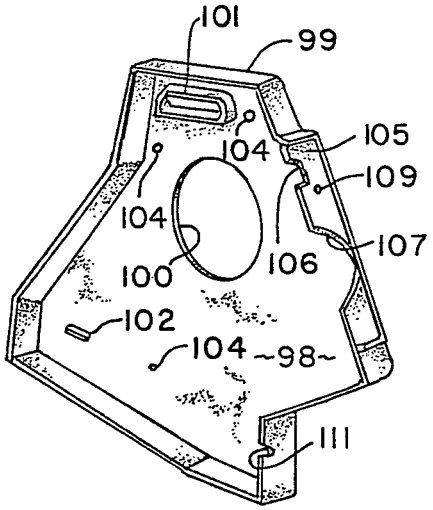
FIG. 6 is a view in perspective of the other of the two parts of the housing.

In this embodiment, the exercise cycle assembly 11 includes a frame 60 with a stanchion 61 in the form of a square hollow column with a socket section 62 sized to slide over and receive the post 55. The socket section has a hole in it, around which a clamping bolt nut 63 is welded or otherwise secured in and on a front wall of the stanchion as viewed in FIG. 3. Projecting downwardly from a back wall of the stanchion, as viewed in FIG. 3, is a spacer finger 64. Near the upper end of the stanchion, on the front wall, a housing bracket 65 is welded at one end, and provided at its other end with a lip 66, in which are two spaced, tapped holes 67. At the upper end of the stanchion 62, the side walls of the stanchion are cut away to form a cradle 68 in which a crank shaft bearing housing 69 is seated and secured. The crank shaft bearing housing 69 carries a conventional pedal crank assembly, with cranks 70, and when assembled, pedals 72. The crank shaft carries at one side of the bearing housing 69 a conventional drive spocket 74.

A fly wheel fork 78 is made up of two arms 79, mirror images of one another, each with a weld section 80 in which the arms are welded to the side walls of the stanchion 62, and at their free ends, an adjustment slot 81, in which a shaft of a fly wheel 84 is mounted. A standard bicycle type roller chain 85 extends around the drive sprocket 74 and around a sprocket fixedly mounted on the fly wheel 84, in the conventional way. The fly wheel 84 has an annular channel around its circumference, in which a drag or tension strap 88 rides. One end of the tension strap is fixed to the cycle assembly frame, and the other end is connected to an adjustment knob 90. A speedometer, or combination speedometer and odometer referred to hereinafter for convenience as speedometer 91 is connected to a suitable gearing mechanism, which is also conventional, on the wheel 84 by means of a cable 93, which, in this embodiment, passes through openings in a front and side wall of the stanchion 62.

In the embodiment shown, the cycle assembly, except for the spacer finger 64, adjustment knob 90, face portion of the speedometer 91, and parts of the wheel 84, strap 88, crank arms 70 and pedals 72, are enclosed in a housing 95.

The housing 95 is made in two parts, called for convenience a sprocket half 97 and an opposite half 117. The sprocket half of the housing has a side wall 98 and a peripheral edge wall 99 projecting perpendicularly from the side wall 98. The side wall has in it an opening 100 only little smaller in diameter than the sprocket 74, a hand hold opening defined by a hand hold wall 101 extending inwardly in the same direction as the edge wall 99, an adjusting slot 102 aligned when the housing is assembled with the slot 81 in the arm 79, and various bolt holes 104. The edge wall 99 has a console section 105, with a tension knob cut-out 106, a speedometer cut-out 107, and a fastener hole 109. A lower front reach of the edge wall has in it a clamp bolt hole cut-out 111.

Figure 2:
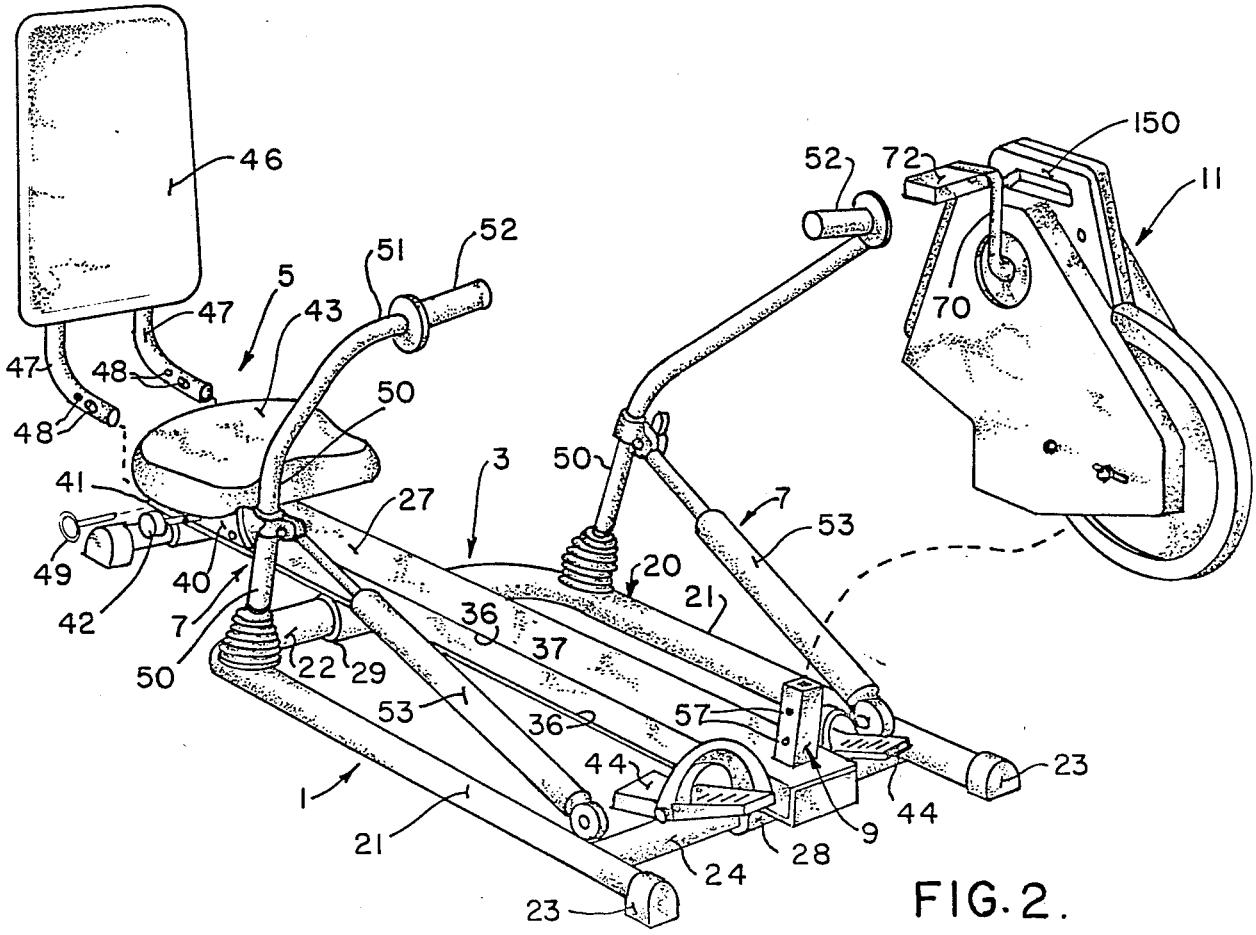
FIG. 2 is an exploded view in perspective of the device shown in FIG. 1, illustrating the demountability of the exercise cycle part and a back rest.
Figure 4:
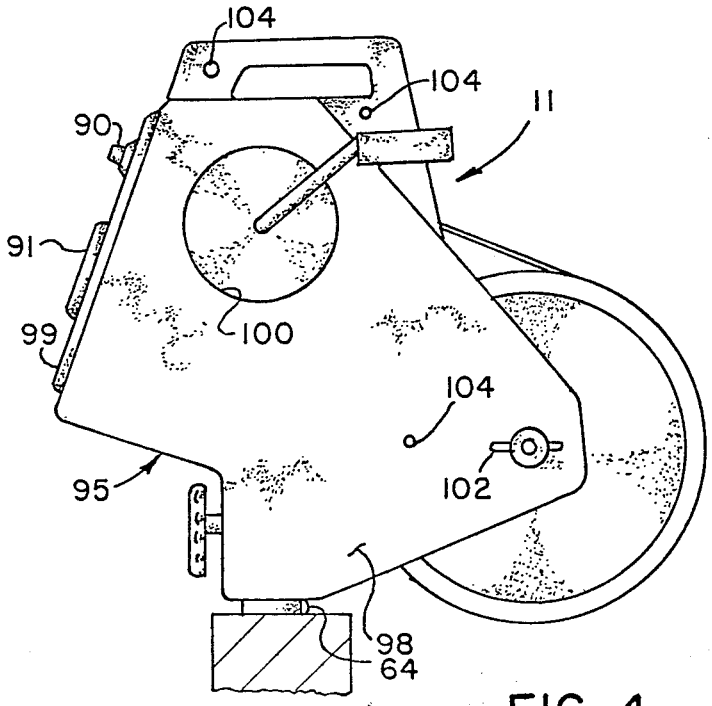
FIG. 4 is a view in side elevation of the exercise cycle assembly of FIG. 3 mounted on the machine frame, which is shown in fragmentary section.

The opposite half 117 of the housing has a side wall 118 and an edge wall 119 that is a mirror image of the edge wall 99 of the sprocket half edge wall 99. The side wall 118 has a crank shaft opening 120, small in comparison with the sprocket opening 100 in the side wall 98, a hand-hold opening defined by a hand hold wall 121, a mirror image of the wall 101, an adjusting slot 122 aligned with the adjusting slot 102, and various bolt holes 124, positioned complementarily to the bolt holes 104. In addition, the side wall 118 has a rectangular debossed area 126 with spaced, vertically aligned key pin-receiving holes 127 in it. Keys 129, inserted in the holes 127, pass through key pin holes 131 in the stanchion sidewall, and through corresponding holes 57 in the post, to provide a positive securement of the exercise cycle assembly to the post 55. The holes 57 shown in FIG. 2 are in the opposite side wall from the side wall 118, but represent the holes 57 on the same side as the side wall 118. As has been indicated, the edge wall 119 has a tension knob cut-out 136, and speedometer cut-out 137, a fastener hole 139 and a clamp bolt hole cut out 141, all mirror images of their counterparts in the edge wall 99. When the various elements of the exercise cycle assembly inside the housing have been assembled, the housing is assembled around them by bolting the two halves through the holes 109 and 139, to the bracket 65, and through the lower holes 104 and 124 to the legs 79, which are provided with tapped holes for that purpose. The adjusting knob 90 and the speedometer 91 are mounted as indicated in FIGS. 3 and 4. When the housing 95 is assembled, the end hole walls 101 and 121 define a handle or hand hold 150.

A clamp bolt 145, with a knob 146, is threaded into the nut 63, through the hole that the nut surrounds, and is used to tighten the stanchion 60 against the post 90 because the key pins 129, though providing positive securement, may permit some play.

Through-bolts, not here shown, having a head at one end and a nut at the other, extend through the holes 104 and 124 adjacent the hand hold openings, to tie the housing parts snugly together around the hand hold or handle 150.

As has been indicated, when the device is to be used as a recumbent exercise cycle machine, the exercise cycle assembly is mounted on the post 9 by slipping the socket section 62 of the stanchion 61 over the post 9. The finger 64, abutting the upper surface of the central beam 27, positions the socket so that the holes 127 in the housing, holes 128 in the assembly frame and holes 57 (on the side of the post opposite the ones shown in FIG. 2) are aligned to receive the key pins 129. The key pins 129 are inserted, and the clamp bolt 145 tightened against the post. If the back 46 is not in position, the frame arms 47 are slid into the sockets provided on the carriage seat, and the keys 49 are inserted. The person using the machine can then sit on the seat, and adjust the position of the seat by loosening the carriage clamp bolt 41 and moving the carriage and seat until the person's feet reach the pedals comfortably. The bolt 41 is then tightened against the side wall 38 of the channel 37 to hold the seat in position. The user can then adjust the tension of the belt 88 to suit his purpose by turning the knob 90, which is readily accessible. In using the exercise cycle, the user can grip the hand grips 52, as one grips the handle grips of the usual exercise cycle machine or of a recumbent type bicycle. The machine can be used as a rowing machine, even with the exercise cycle assembly mounted on the post 9. However, if it is desired to attach a platform to the post, the clamp bolt 145 is loosened, the keys 129 are pulled out, and the exercise cycle assembly lifted off by means of the handle 150. If one wants to use the machine as a rowing machine, the back 46 can be taken off by removing the pins 49 and sliding the ends of the frame out of the sockets on the carriage, and the carriage clamp bolt 41 is loosened to permit the carriage, hence the seat, to roll back and forth on the central beam 27.

Numerous variations in the construction of the device of this invention, within the scope of the appended claims, will occur to those skilled in the art in the light of the foregoing disclosure. Merely by way of illustration, the frame structure can be quite different, with a pair of tracks rather than a central beam, as long as there is a cross member to which the post 9 can be secured. The post 9 can be made of a size relative to the stanchion 60 so that the stanchion slides inside the post. In that case, the clamping means will be carried by the post rather than by the stanchion. Various other devices can be mounted in the console portion of the housing. The form of the handle part of the housing can be varied such, for example, as by making the opening closed at only one end instead of both ends. Different means of mounting the exercise cycle assembly and the seat back can be employed. These are merely illustrative.

Having thus described the invention, what is claimed and desired to be secured by Letters Patent is:

1. In a stationary exercise device having an elongated base frame and a seat supported by said base frame adjacent one end thereof, the improvement comprising a non-circular, substantially vertical post mounted on and projecting above said frame adjacent the other end of said frame, exercise cycle means including means for selectively mounting said exercise cycle means on said post, said exercise cycle means comprising pedal means positioned to be reached by the feet of a human operator sitting on said seat, said pedal means including cranks, a crank shaft, a bearing housing surrounding said crank shaft, and a drive sprocket carried by said crank shaft on one side of said housing, flywheel means connected to be driven by said drive sprocket, and a frame including an open-bottomed hollow stanchion of a cross-sectional configuration complementary to the external configuraton of said post and of a size to fit closely but slidably over said post, said stanchion having a cradle part at its upper end to which said bearing housing is secured and a fly wheel fork made up of two, substantially mirror image arms, each with a weld section welded to said stanchion a free slotted end adjustably receiving a shaft of said fly wheel means, housing mounting bracket means secured to said stanchion, and a housing mounted on said bracket means, said stanchion supporting the entire exercise cycle means, whereby the entire exercise cycle means, including said flywheel, is mountable and demountable as a unit from the said post.

2. The improvement of claim 1 including a speedometer, selectively variable pedalling resistance means and control means for selectively varying said resistance means, said speedometer, resistance means and control means being mounted in said housing, said control means being positioned for easy access to a human operator sitting on said seat, said speedometer, resistance means and control means being parts of the unitary exercise cycle means.

* * * * *